US005341189A

United States Patent [19]

Helfer et al.

[11] Patent Number: 5,341,189

[45] Date of Patent: Aug. 23, 1994

[54] PHOTOSENSITIVE MATERIAL PROCESSOR

[75] Inventors: Jeffrey L. Helfer, Webster; Mark J. Devaney, Jr., Rochester, both of N.Y.

[73] Assignee: Eastman Kodak Company, Rochester, N.Y.

[21] Appl. No.: 53,780

[22] Filed: Apr. 27, 1993

[51] Int. Cl.[5] ..... G03D 3/02

[52] U.S. Cl. ..... 354/324

[58] Field of Search ..... 354/324; 430/398; 134/64, 64 R, 122 P, 122 R

[56] References Cited

U.S. PATENT DOCUMENTS 4,719,173 1/1988 Hahm ..... 430/398
4,804,990 2/1989 Jessop ..... 354/324
5,001,506 3/1991 Nakamura ..... 354/324
5,063,141 11/1991 Nakamura ..... 430/398
5,177,521 1/1993 Mogi et al. ..... 354/298

*Primary Examiner*—D. Rutledge
*Attorney, Agent, or Firm*—Dana M. Schmidt

[57] ABSTRACT

A processor for processing photosensitive material having a first processing tank containing a first processing fluid containing at least one component of a first concentration and a second processing tank containing processing fluid having the same component to that of the first processing fluid, however, the concentration of the component being different than the first concentration. A weir is provided for causing fluid to flow from the first tank to the second tank resulting from the hydrostatic pressure of the first fluid in the first tank. The weir has a configuration such that concentration difference between processing fluid in said tanks does not change significantly over a predetermined period of time.

34 Claims, 3 Drawing Sheets

PHOTOSENSITIVE MATERIAL PROCESSOR

FIELD OF THE INVENTION

This invention relates to an apparatus for processing of photosensitive material.

BACKGROUND OF THE INVENTION

Prior art processors, in particular those directed for use in developing medical x-ray film, typically include developer, fix and wash solutions which are applied to exposed film. The photosensitive material to be developed first passes through a first tank containing a developer, then a second tank containing the fixer solution and finally through a third tank containing the wash solution. These tanks are substantially fluidly isolated from each other. Overflow replenishment is typically provided to each tank so as to replace the chemicals consumed by the film processing. This replenishment process dispenses a small volume of fresh processing solution into the appropriate processing tank, enabling an equal volume of "used" solution to overflow through a weir located typically in an opposite position within the same tank.

It is also known in the prior art to provide a plurality of tanks for each of the development, fix and wash solutions. This type processor is typically referred to as a multistage processor. In such processors the processing solution flows from one tank into the adjacent tank and so forth. For example, there may be provided three fluid processing tanks for holding the developing solution. The film is passed successively through the tanks and the development solution overflows from the first tank to the second tank and from the second tank to the third tank, and finally to drain. Likewise, a plurality of tanks containing the fix and wash solutions may also be provided. The processor may be operated such that the processing fluid flows concurrently, or counter-current with respect to the path of the travel of the film through the processor. Multi-stage concurrent and counter-current processors have been found to be more effective for developing, fixing and washing medical x-ray films. These multi-stage developing processors require very small amounts of fluid, typically 5 to 10 ml. per sheet of film, to be transferred between adjacent processing tanks at regular intervals. Failure to do so would result in improper chemical concentration distributions within the processing tank, and improper processing of the film. Typical means for transferring the solution from one tank to the next tank is accomplished by allowing the fluid simply to pass over a weir from one tank to the adjacent tank. However, several problems occur with such a process. Because of the very low volume measure replenishment rates, the overflow from one tank to the next is quite unpredictable. Such a system would result in fresh replenisher being contained in a single tank until the total volume delivered to that tank becomes quite large. The tank receiving the replenisher would become overly replenished while adjacent tanks become under-replenished. The variability of chemical concentration within each tank would be excessive, making efficient processing control very difficult or impossible to achieve. The situation is further complicated by the fact that termination of flow through a weir is difficult to predict. Flow ceases when the stream exiting the weir detaches from the liquid within the weir and leaves a bolus with an advancing contact angle at the weir exit that is less than the critical advancing contact angle, the contact angle required to advance the bolus through and/or out of the weir. Random vibrations caused by operation of the processor can also affect the initiation and termination of flow between adjacent tanks.

One response to this situation is the utilization of fluid metering pumps to transfer liquid between adjacent processing tanks. This approach is undesirable due to the large number of pumps that would be required, and the need to precisely match the output of each to avoid accumulating or depleting fluids within the tanks.

Applicants have developed a simple and improved apparatus and method for accurately controlling the flow of processing fluids from one tank to the next. The solution provided by the present invention minimizes undesirable chemical transfer by either chemical diffusion or random variations in hydrostatic pressure differences and is also easily maintained.

SUMMARY OF THE INVENTION

In one aspect of the invention there is provided a processor for processing photosensitive material, comprising:

a first processing tank containing a first processing fluid having at least one component of a first concentration;

a second processing tank containing processing fluid having a component similar to that of said first processing fluid, however, the concentration of the component being different than the first concentration; and means for causing fluid of the first concentration to flow from the first tank to the second tank resulting from the hydrostatic pressure of the first fluid in the first tank, wherein the means comprises a passage having an inlet in fluid communication with the first processing fluid in the first processing tank and an outlet in fluid communication with the processing fluid in the second processing tank.

In another aspect of the present invention there is provided a weir for use in an apparatus having a plurality of tanks containing a liquid having at least one component, the concentration of the component in the liquid being different in each said tanks. The weir allowing replenishment liquid to flow from the tank having a first concentration into the tank having a second component concentration. The weir comprising a channel having an inlet in fluid communication with the processing fluid in one of said plurality of tanks and an outlet in fluid communication with the processing fluid in one of the other of said plurality of tanks, the channel having a configuration such that the concentration difference between processing fluid in said tanks does not change significantly over a predetermined period of time.

Other objects and advantages will become apparent from the following description presented in connection with the accompanied drawings wherein:

DETAILED DESCRIPTION OF THE DRAWING

Figure 1A:
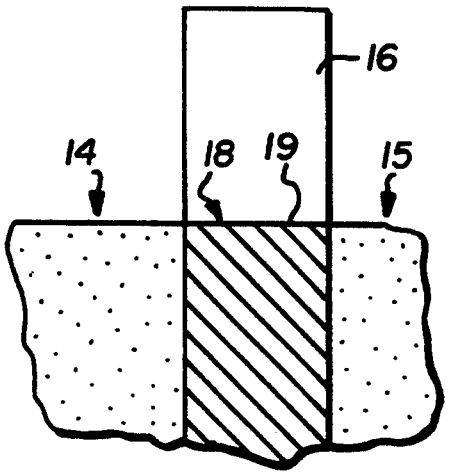
FIG. 1A (PRIOR ART)
FIGS. 1A–1C illustrate an enlarged partial side view of a prior art weir used to allow fluid to flow from a first tank to a second tank.
Figure 1B:
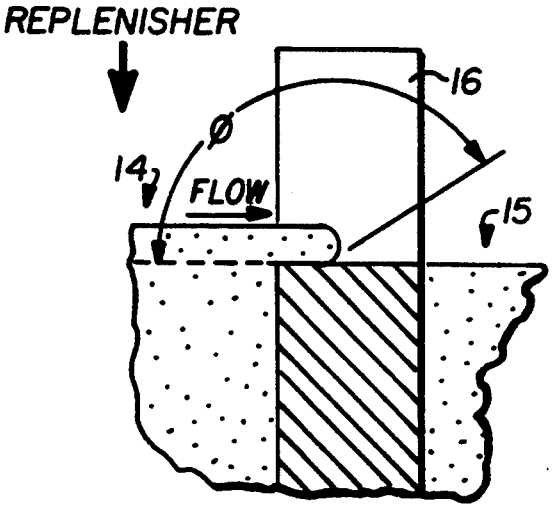
FIG. 1B (PRIOR ART)
Figure 1C:
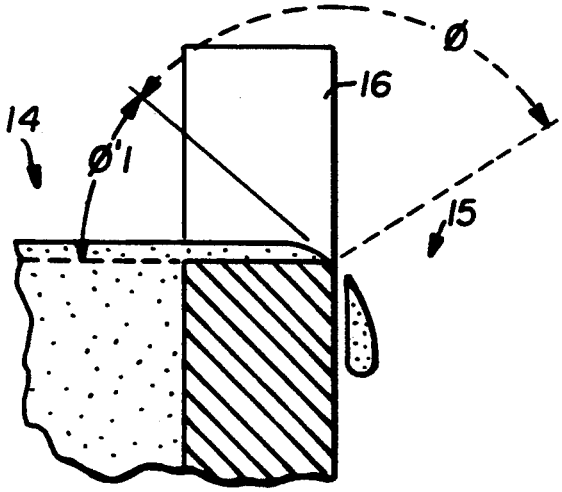
FIG. 1C (PRIOR ART)

Referring to FIGS. 1A–1C, there is illustrated a conventional weir for use in a film processor made in accordance with the prior art. In particular, the processor comprises a first tank 14 and a second tank 15 separated by a common wall 16. A weir 18 is provided in wall 16 for allowing processing fluid to flow from tank 14 into tank 15. The weir 18 includes an upper surface 19 over which the processing fluid will flow from tank 14 into tank 15. FIG. 1A illustrates the level of the liquid in tank 14 prior to the addition of replenisher. FIG. 1B illustrates the fluid flow from tank 14 into tank 15 when a sufficient amount of replenishment solution has been added to tank 14. As illustrated in FIG. 1B, a high surface tension fluid, which is typically found in processing solutions, produces a large advanced contact angle Q and tends to inhibit the flow of fluid from tank 14 into tank 15. Fluid flow from one tank to the adjacent tank occurs when the advancing fluid contact angle Q exceeds the critical advancing contact angle at the exit of weir 18 into the adjacent tank. The indeterminate nature of fluid properties and the wettability of the weir surfaces make this condition quite variable. As a result, the level to which the fluid in tank 14 must rise in order to initiate flow into tank 15 can not be predicted with acceptable accuracy. The large area of the tank 14, which is typically approximately 500 $cm^2$, indicates that the variability of liquid that must be placed into tank 14 to induce fluid flow through the weir 18 is quite large. For example, the addition of 50 cubic cm of liquid into tank 14 would increase fluid height in tank 14 by only 0.10 cms. In typical multi-stage co-current and/or counter-current fluid processing situations, very low volumetric replenishment rates are utilized. For example, replenishment rates of 5 to 10 cubic cm per square foot of film are typical. The unpredictable nature of the prior art weir overflow systems can result in fresh replenisher being contained in tank 14 until the total volume delivered to tank 14 becomes quite large. The tank 14 receiving replenisher would become over-replenished, while the adjacent tank 15 would become under-replenished. The variability of chemical concentration within each tank would be excessive, making sufficient process control very difficult or impossible to achieve.

The foregoing situation is complicated by the fact that termination of fluid flow through a weir is also difficult to predict. Flow ceases when stream exiting the weir detaches from the liquid within the weir and leaves a bolus with advancing contact angle at the weir exit that is less than the critical angle as is illustrated in FIG. 1C. Exactly when and how this bolus detaches can be significantly influenced by the fluid properties, especially surface tension. Additionally variations in surface tension can affect volume of liquid transferred.

A further problem with prior art processors is that random vibrations applied or experienced by the processor, (for example, vibrations created by the operation of motors, etc.) will also affect fluid initiation and termination through the weir.

Figure 1D:
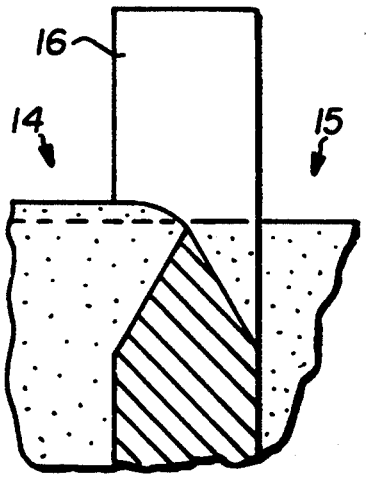
FIG. 1D (PRIOR ART)
FIG. 1D illustrate an enlarged partial side view of a another prior art weir used to allow fluid to flow from a first tank to a second tank.

Referring to FIG. 1D, there is illustrated a another weir design made in accordance with the prior art (like numerals representing like parts) which helps to minimize the magnitude of the problem by minimizing the number of sharp corners over which the fluid must advance. However, since this solution does not eliminate all surfaces and sharp corners it is still unacceptable.

Figure 2:
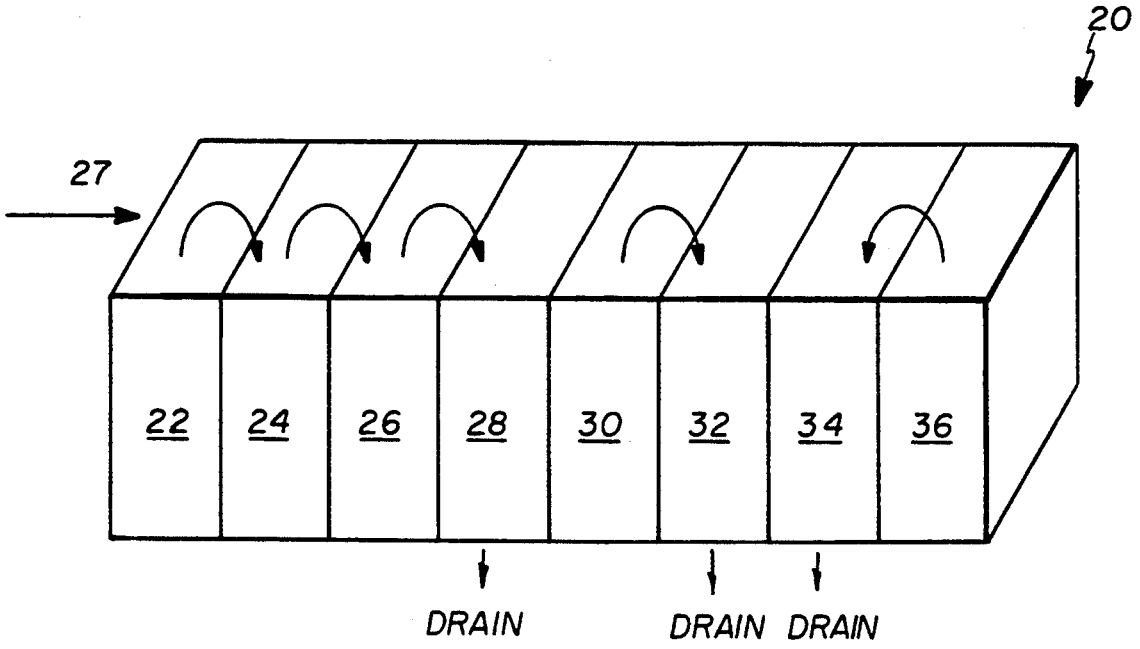
FIG. 2 is a schematic diagram of a processor made in accordance with the present invention.

Referring to FIG. 2, there is illustrated, in diagrammatic form, a processor 20 made in accordance with the present invention. In particular, the processor 20 is provided with a plurality of processing tanks 22, 24, 26, 28, 30, 32, 34, 36. In the particular embodiment illustrated, the processing tanks 22-28 contain development solution and the development solution flows from tank 22 into tank 24, from tank 24 into tank 26, then from tank 26 into tank 28, and then to drain. The photosensitive material passes through the processor in the direction indicated by arrow 27. Thus, in the preferred embodiment illustrated, the development processing tanks are used in a co-current mode. The concentration of certain components of the processing liquid (developer) in tanks 22 through 28 progressively varies in each succeeding tank. For example, the amount of hydroquinone in the developer decreases from a maximum in tank 22 to a minimum in tank 28. At the same time sodium bromide is the greatest in tank 28 and decreases progressively to a minimum in tank 22. Hydroquinone is the reactant in the developer and Sodium Bromide is the undesired by product which inhibits further development of the photosensitive material. Thus, level of each of these components in each of the tanks will affect the operational efficiency of the system. Therefore, in the particular embodiment illustrated, the concentration of the hydroquinone component of the developer in tank 22 is greater than the concentration in tank 24, the concentration of hydroquinone in tank 24 is greater than in tank 26, and the concentration of the hydroquinone in tank 26 is greater than in tank 28. Likewise, the concentration of sodium bromide in tank 28 is greater than in tank 26, the concentration of sodium bromide in tank 26 is greater than in tank 24, and the concentration of sodium bromide in tank 24 is greater than in tank 22. The particular concentration in each tank is selected by the processor designer.

Processing tanks 30,32 contain a fixing solution. In the particular embodiment illustrated, fixing solution overflows from tank 30 into tank 32. A replenishment fix solution is introduced into tank 30. The excess fix solution from tank 32 overflows directly to the drain. The fixing solution will also have a component of interest, for example ammonium thiosulfate, that can be controlled and/or monitored.

Tanks 34,36 are wash tanks wherein water is initially replaced into tank 36 and overflows into tank 34 which then overflows to drain. The wash cycle is illustrated as counter-current flow. The wash tank may also have a component that is to be monitored and/or controlled.

It is to be understood for the purpose of the present invention the direction of flow of the processing solution in the developer, fix and wash sections may be varied as desired, i.e., co-current or counter-current and the component to be monitored/and or controlled will vary depending on the particular chemistry being used.

Figure 4:
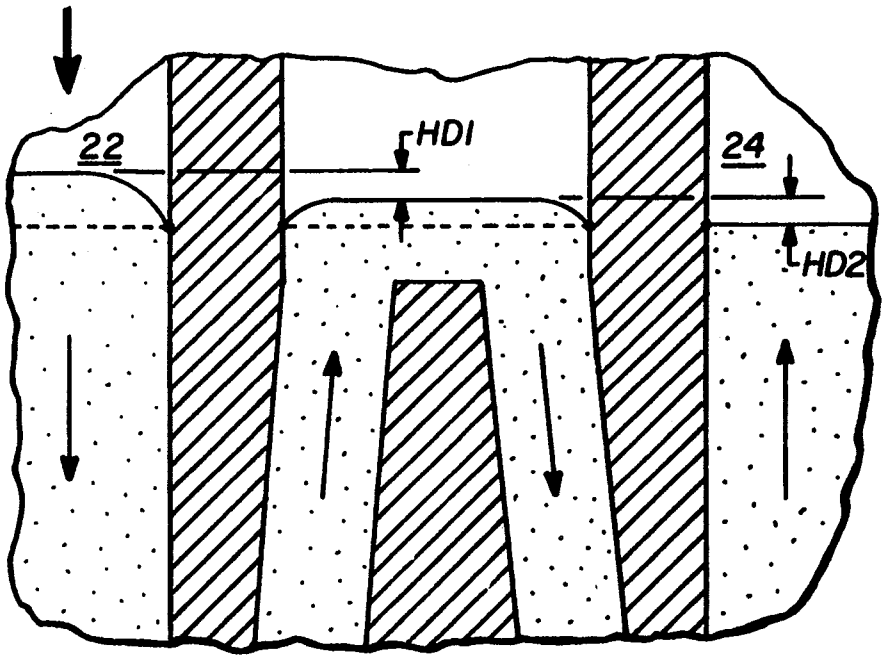
FIG. 4 is a further enlarged view of a portion of the weir of FIG. 3 illustrating the fluid level immediately after replenishment fluid has been added to the first tank and prior to equalization of the hydrodynamic fluid level.
Figure 3:
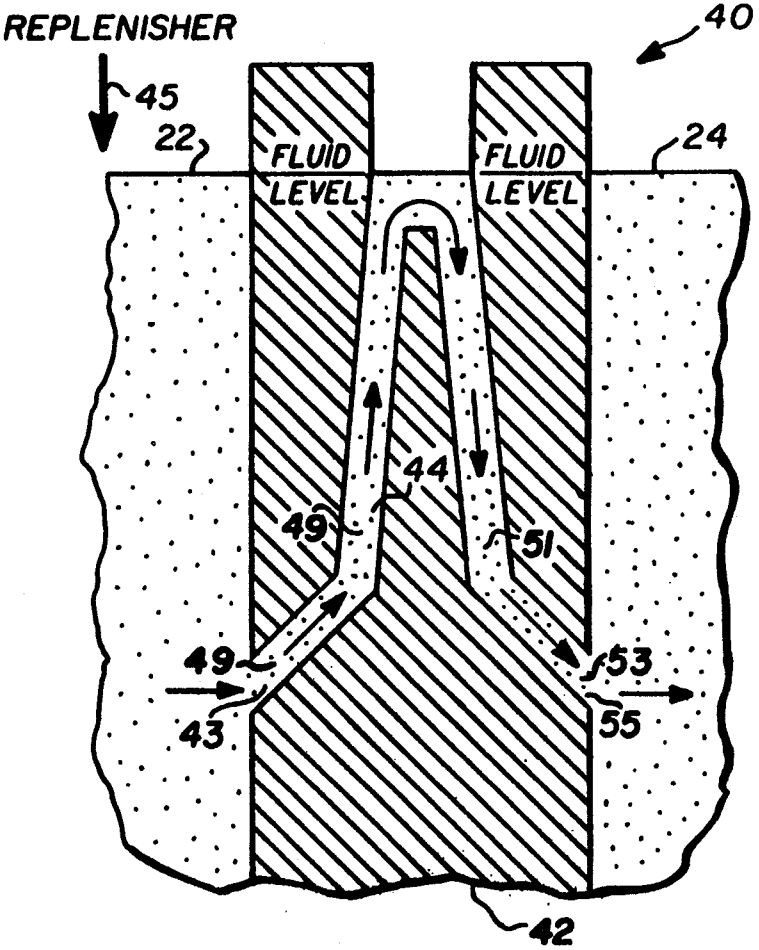
FIG. 3 is an enlarged cross-sectional view of a portion of the wall separating the first tank from the second tank of FIG. 1 illustrating a weir made in accordance with the present invention.

Referring to FIG. 3, there is illustrated a weir 40 made in accordance with the present invention. It is to be understood that the appropriate weirs 40 are provided between the processing chambers 22–36 as appropriate. In the particular embodiment illustrated, weirs 40 are provided between tanks 22 and 24, tanks 24 and 26, tanks 26 and 28, tanks 30 and 32, and tanks 34 and 36. For the sake of clarity, only a single weir 40 will be discussed in detail, it being understood that the other weirs 40 provided are similar in construction and operation. In particular, the weir 40 illustrated allows processing solution to flow from tank 22 into tank 24. The weir 40 is provided in the wall 42 separating tanks 22 and 24. In particular, the wall 42 is provided with a narrow passage/channel 44 connecting tank 22 to tank 24. In the particular embodiment illustrated passage 44 comprise a first generally section 47 which extends from an inlet 43 in tank 22 into wall 42 at a relatively small inclined angle, for example form about 10 to 30 degrees, a second generally upward vertically extending section 49 which extends from the first section 47 at a greater inclined angle with respect to the horizon, eg. of about 40 to 80 degrees, a third substantially downward vertically extending section 51 which extends toward tank 24 at about the same inclination as section 49 except opposite in direction, and finally a fourth section 53 which extends from section 51 at the same amount inclination as section 47 and terminates at outlet 55 at tank 24. The junction where sections 49,51 of passage 44 meet is preferably opened to the exterior of the tank. This allows for easy cleaning of the sections 47,49,51,53 of passage 44. However, if desired the passage 44 need not be open to the environment or even located in wall 42. The passage 44 is preferably curved or has at least one bend or directional turn along its length as illustrated so as to minimum any mixing of the liquids between the connected tanks due to movement or vibrations imparted to processor. In the embodiment illustrated the passage 44 has a generally inverted "V" shape with the ends slightly flared out. It is to be understood that passage 44 may take many other shapes and configurations not illustrated, for example but not by way of limitation an inverted "U" shape, a "C" shape, a "S" shape, or a "Z" shape. The passage 44 has a size and configuration which allows fluid to flow from one tank into the other when required, such as during replenishment, but also does not adversely affect the difference in concentration of the liquids in the two connected tanks either during use or non use of the processor. Fluid transfer from tank 22 into tank 24 is initiated by the addition of a small amount of liquid replenishment fluid, as indicated by arrow 45, into tank 22 as is typically done in the prior art. At the instant the replenishment solution is added to tank 22, but prior to the onset of fluid flow through passage 44, liquid level in tank 22 will rise and also increase the advancing contact angle at the interface of the fluid with the tank wall as illustrated in FIG. 4, thus creating a hydrostatic head difference, represented by HD1 between the fluid in tank 14 and within the transfer weir 40. Fluid flow from tank 22 into the transfer passage 44 diminishes this difference, but then creates a hydrostatic head difference between the surface of the fluid in the passage 44 and tank 24 as represented by HD2. This difference enables fluid to flow from passage 44 to tank 24. Fluid flow is terminated when levels of liquid within tank 22, the transfer weir 44 and the tank 24 are equal. In actual practice, this process occurs nearly simultaneously. This process is repeated between all downstream tanks in the processor.

Unlike the prior art, the onset and termination of fluid flow of the present invention is determined by the hydrostatic head differences, and does not require fluid-wall contact menisci in either adjacent tanks or the transfer passages to produce a flow of liquid. Consequently, variations in surface wettability, specifically advancing the fluid contact angle, variation in fluid properties, weir design, material properties or random vibration will not influence the flow of the present invention.

The impetus to initiate fluid flow between adjacent tanks is provided by a single fluid pump located at an upstream tank. The addition of small amounts of fluid to the furthest upstream tank will result in inducing flow through all of the adjacent connected processing tanks.

It is important that the cross-sectional area and length of the passage 44 be properly designed for various reasons. First, a longer, smaller cross-sectional area can provide viscous damping of fluid flow. This is important to insure that random hydrostatic pressure differences, such as that caused by rippling of the fluid surfaces, between adjacent tanks can not produce any net flow. Secondly, a longer, smaller cross-sectional area minimizes the rate of transfer of chemicals between adjacent tanks, due to chemical diffusion and/or by mixing of the fluids between the tanks due to turbulence in the processing fluid in the connecting tanks. The need to maintain concentration profiles between adjacent tanks is an important consideration in co-current and counter-current processors. In the particular embodiment illustrated, channel 44 has a circular cross sectional configuration, a diameter of about 1 cms and a length of about 20 cms.

The time required for the concentration of a chemical species in the second tank to reach a particular value through molecular diffusion can be expressed by the following relationship:

$$t = \frac{Vl}{2\alpha A} \ln\left(\frac{1}{1 - \frac{2C_2}{C}}\right)$$

wherein:

t = time required for concentration of tank 2 to reach particular value

V = volume of tank 1 and tank 2

1 = length of passage

A = cross-sectional area of passage

C = initial concentration of species in tank 1

$C_2$ = initial concentration of species in tank 2

$\alpha$ = diffusivity of species in liquid in passage and tanks

For example, in a processor having a fluid fixing solution having a diffusivity $\alpha$ of $14.5\times10^{-6}cm^2/sec$, a concentration difference between adjacent processing tanks of 0.065 $gm/cm^3$, a passage having a circular cross-section and a diameter of 1.0 cms and a length of 20 cms, creates a chemical diffusivity Transfer Rate of approximately 0.13 mg/hr of monitored component between adjacent tanks. This figure represents 0.05% of the mass of the monitored component of the processing solution transferred between tanks by single 14×17 inch duplitized medical x-ray film with a 10.0 $\mu m$ swell. Using the above relationship, it would take approximately 2000 hours for an equal mass of ammonium thiosulfate to transfer through the passage 44 by molecular diffusion. By comparison, a duct having a diameter of 2.0 cms and a length of 5 cms would require only 124 hours for molecular diffusion to occur. The diffusivity transfer rate of the monitored component is generally not greater than 6 mg/hr. In the particular embodiment illustrated the transfer rate is about 0.13 mg/hr.

It is desirable that the rate of transfer of the monitored photochemical components between connecting tanks resulting from all causes (including chemical diffusion) be such that the concentration difference between the tanks is not substantially affected over a predetermined period of time. Thus, the cross-sectional size and shape of the connecting passage may be varied so long as the rate of chemical transfer between the tanks is maintained below the desired value.

In a typical multi stage film processor, the chemistry of each of the separate tanks for a given solution when the processor is initially filled is generally the same. After some period of time of operation of the processor, the concentration of the monitored component in each of the individual tanks of a particular chemistry, for example the developer, will change until at some point in time continued operation of the processor will not cause any significant change in the concentrations in each the tanks. This is typically referred as seasoned chemistry. Thus, at this point in time each of the tanks will have an monitored component concentration different from the other tanks. Depending on the chemistry, the number of tanks containing the same type chemistry and various other factors, a concentration difference will be established between adjacent tanks. In the particular embodiment illustrated, the concentration of the monitored component, sodium bromide, of the developer in tank 22 is 5.0 gms/liter, in tank 24 is 5.6 gms/liter, in tank 26 is 6.6 gms/liter, and in tank 28 is 8.4 gms/liter. Thus there is formed a first Δ concentration between tanks 22,24, a second Δ concentration between tanks 24,26, and a third Δ concentration between tanks 26,28. In the operation of a multistage processor it is desirable that the delta concentrations of the seasoned chemistry between adjacent connecting tanks does not change substantially during periods of non use. Therefore the rate of chemical transfer due to diffusion between adjacent tanks (i.e. through the connecting passage) should be minimized during periods of non use. This is controlled by the configuration of the passage. In particular, the ratio of the cross sectional area of the passage to the length of the passage should be equal to or less than about 1.0, generally less than about 0.5, and most preferably less than about 0.05. In the particular embodiment illustrated the ratio is about 0.04. When the processor is not in use, if the delta concentrations between adjacent tanks change significantly, when the processor is restarred, the benefits of a multi stage processor will have been reduced in proportion to the change in the delta concentration between adjacent connecting tanks. In order to obtain the benefits of the multistage processing system, it is desirable that the delta concentration between connecting tanks does not change more than about 50% over a three day period of non use, preferably no more than about 10% over a three day period. Most preferably the delta concentration between adjacent tanks does not change more than about 5% over a two week period of non use.

In the preferred embodiment illustrated only a single passage is used for transferring fluid between adjacent tanks. However, the present invention is not so limited. For example, a plurality of smaller passages may be substituted for the single passage 44. In such event, the sum effect of the plurality passages will be combined so as to provide the same results as the single passage described herein. The size of the plurality of passages being limited by the ability of the smaller passages to provide the desired hydrostatic pressure to transfer replenishment fluid to the adjacent tank without having impermissible mixing or diffusion of the liquids between the connecting tanks.

The present invention provides a weir for transferring small amounts of fluid between multiple adjacent tanks in a processor which does not require any special dispensing apparatus or fluid ducting in a manner which minimizes undesirable chemical transfer, either by chemical diffusion, or random variation in hydrostatic pressures and which is also easy to maintain.

It is to be understood that various other changes and modifications may be made without departing from the scope of the present invention. The present invention being defined by the following claims.

We claim:

1. A processor for processing photosensitive material, comprising:

a first processing tank containing a first processing fluid containing at least one component of a first concentration;

a second processing tank containing processing fluid having the same component to that of said first processing fluid, however, said concentration of said component in said second processing tank being different than said first concentration;

a weir for allowing fluid of said first concentration to flow from said first tank to said second tank resulting from the hydrostatic pressure of said first fluid in said first tank, said weir comprising means forming a passage having an inlet in fluid communication with said first processing fluid in said first processing tank and an outlet in fluid communication with the processing fluid in said second processing tank, said passage having a configuration such that the diffusivity transfer rate between said tanks is not greater than about 6 milligrams per hour.

2. A processor according to claim 1 wherein said passage comprises a conduit having a substantially circular cross-sectional shape and a diameter of approximately 1.0 centimeters and a length of approximately 20 centimeters.

3. A processor according to claim 1 wherein the diffusivity transfer rate between said tanks is about 0.13 milligrams per hour of the concentration of the component of the processing fluid.

4. A processor for processing photosensitive material, comprising;

a first processing tank containing a first processing fluid containing at least one component of a first concentration;

a second processing tank containing a processing fluid having the same component to that of said first processing fluid, however, said concentration of said component in said second processing tank being different than said first concentration;

a weir for allowing fluid of said first concentration to flow from said first tank to said second tank resulting from the hydrostatic pressure of said first fluid in said first tank, said weir comprising means forming a passage having an inlet in fluid communication with said first processing fluid in said first processing tank and an outlet in fluid communication with the processing fluid in said second processing tank, said passage having a configuration such that the difference between said first and second concentrations does not change by more than about 50% over a three day period of non use of said processor.

5. A processor according to claim 4 wherein the difference between said first and second concentrations does not change by more than about 10% over a three say period of non use of said processor.

6. A processor according to claim 4 wherein the difference between said first and second concentrations does not change by more than about 5% over a two week period of non use of said processor.

7. A processor for processing photosensitive material, comprising:

a plurality of processing tanks containing a liquid having at least one component whose concentration is changed as a result of the photosensitive material passing through the processor, the concentration of the component in the liquid is highest in one of said tanks; and means for introducing replenishment liquid from the tank having highest component concentration into an adjacent tank having the next highest component concentration, said means comprising a channel having an inlet in fluid communication with the processing fluid of one of said plurality of tanks and an outlet in fluid communication with the processing fluid in one of the other of said plurality of tanks, said channel having a configuration such that the diffusivity transfer rate between adjacent tanks is not greater than about 6 milligrams per hour.

8. A processor according to claim 7 wherein said channel has a shape and configuration such that the diffusion rate for the channel will to substantially affect the concentration of the active component in the two adjacent tanks.

9. A processor according to claim 7 wherein said processor is of the counter current type.

10. A processor according to claim 7 wherein said processor is of the co-current type.

11. A processor according to claim 7 wherein said channel has a substantially circular cross-sectional shape and a diameter of approximately 1.0 centimeters and a length of approximately 20 centimeters.

12. A processor according to claim 7 wherein the diffusivity transfer rate between said adjacent tanks is about 0.13 milligrams per hour of the concentration of the component of the processing fluid.

13. A processor for processing photosensitive material, comprising:

a plurality of processing tanks containing a liquid having at lest one component whose concentration is changed as a result of the photosensitive material passing through the processor, the concentration of the component in the liquid is highest in one of said tanks; and means for introducing replenishment liquid from the tank having a highest first component concentration into an adjacent tank having the next highest, second component concentration, said means comprising a channel having an inlet in fluid communication with the processing fluid in one of said plurality of tanks and an outlet in fluid communication with the processing fluid in one of the other of said plurality of tanks, said channel having a configuration such that the difference between said first and second concentrations does not change by more than about 50% over a three day period of non use of said processor.

14. A processor according to claim 13 wherein the difference between said first and second concentrations does not change by more than about 10% over a three day period of non use of said processor.

15. A processor according to claim 13 wherein the difference between said first and second concentrations does not change by more than about 5% over a two week period of non use of said processor.

16. A processor for processing photosensitive material, comprising:

a first processing tank containing a first processing fluid;

a second processing tank containing a second processing fluid; and means for causing said first processing fluid to flow from said first tank to said second tank resulting from the hydorstatic pressure of said first fluid in said first tank, said means comprising a passage having an inlet in fluid communication with said first processing fluid in said first processing tank and an outlet in fluid communication with the processing fluid in said second processing tank, said passage having a configuration such that the the diffusivity transfer rate of components between said tanks is not greater than about 6 milligrams per hour.

17. A processor according to claim 16 wherein said passage comprises a conduit having a substantially circular cross-sectional shape and a diameter of approximately 1.0 centimeters and a length of approximately 20 centimeters.

18. A processor according to claim 16 wherein the diffusivity transfer rate between said tanks is about 0.13 milligrams per hour of the concentration of the component of the processing fluid.

19. A processor for processing photosensitive material, comprising:

a first processing tank containing a first processing fluid;

a second processing tank containing a second processing fluid; and means for causing said first processing fluid to flow from said first tank to said second tank resulting from the hydrostatic pressure of said first fluid in said first tank, said means comprising a passage having an inlet in fluid communication with said first processing fluid in said first processing tank and an outlet in fluid communication with the processing fluid in said second processing tank, said passage having a length and a cross-sectional area wherein the ratio of the cross sectional area to length is equal to or less than about 1.0.

20. A processor according to claim 19 wherein the ratio of the cross sectional area to length is equal to or less than about 0.5.

21. A processor according to claim 19 wherein the ratio of the cross sectional area to length is equal to about 0.04.

22. A weir for use in an apparatus having a plurality of tanks containing a liquid having at least one component, the concentration of the component in the liquid being different in each said tanks, said weir allowing for replenishment liquid to flow from the tank having first concentration into an adjacent tank having a second component concentration, said weir comprising a channel having an inlet in fluid communication with the processing fluid in one of said plurality of tanks and an outlet in fluid communication with the processing fluid in one of the other of said plurality of tanks and having a configuration such that the diffusivity transfer rate between said adjacent tanks is not greater than about 6 milligrams per hour.

23. A weir for use in an apparatus having a plurality of tanks containing a liquid having at least one component, the concentration of the component in the liquid being different in each said tanks, said weir allowing for replenishment liquid to flow from the tank having first concentration into an adjacent tank having a second component concentration, said weir comprising a channel having an inlet in fluid communication with the processing fluid in one of said plurality of tanks and an outlet in fluid communication with the processing fluid in one of the other of said plurality of tanks and having a length and cross-sectional shape such that the ratio of the cross sectional area of said shape to said length are equal to or less than about 1.0.

24. A weir for use in an apparatus having a plurality of tanks containing a liquid having at least one component, the concentration of the component in the liquid being different in each said tanks, said weir allowing for replenishment liquid to flow from the tank having first concentration into an adjacent tank having a second component concentration, said weir comprising a channel having an inlet in fluid communication with the processing fluid in one of said plurality of tanks and an outlet in fluid communication with the processing fluid in one of the other of said plurality of tanks and having an configuration such that the difference between said first and second concentrations does not change by more than about 50% over a three day period of nonuse of said processor.

25. A weir according to any of claims 22, 23 or 24 wherein said apparatus comprises a processor for processing photosensitive material.

26. A processor for processing photosensitive material, comprising:

a first processing tank containing a first processing fluid containing at least one component of a first concentration;

a second processing tank containing processing fluid having the same component to that of said first processing fluid, however, said concentration of said component in said second processing tank being different than said first concentration;

a weir for allowing fluid of said first concentration to flow from said first tank to said second tank resulting from the hydrostatic pressure of said first fluid in said first tank, said weir comprising means forming a passage having an inlet in fluid communication with said first processing fluid in said first processing tank and an outlet in fluid communication with the processing fluid in said second processing tank, said passage comprising a conduit with a predetermined length and cross-sectional shape, the ration of the cross sectional area of said shape to said length being equal to or less than about 1.0.

27. A processor according to claim 26 wherein the ratio of the cross sectional area to length is equal to or less than about 0.5.

28. A processor according to claim 27 wherein the ratio of the cross sectional area to length is equal to about 0.04.

29. A processor for processing photosensitive material, comprising:

a plurality of processing tanks containing a liquid having at least one component whose concentration is changed as a result of the photosensitive material passing through the processor, the concentrations of the component in the liquid is highest in one of said tanks; and means for introducing replenishment liquid from the tank having highest component concentration into an adjacent tank having the next highest component concentration, said means comprising a channel having an inlet in fluid communication with the processing fluid of one of said plurality of tanks and an outlet in fluid communication with the processing fluid in one of the other of said plurality of tanks, said channel having a length and a cross-sectional area such that the ratio of the cross-sectional area to said length is equal to or less than about 1.0.

30. A processor according to claim 29 wherein the ratio of the cross sectional area to said length is equal to or less than about 0.5.

31. A processor according to claim 30 wherein said ratio of the cross sectional area to length is equal to about 0.04.

32. A processor for processing photosensitive material, comprising:

a first processing tank containing a first processing fluid;

a second processing tank containing a second processing fluid, said tanks containing a processing component at a concentration that varies between said tanks; and means for causing said first processing fluid to flow from said first tank to said second tank resulting from the hydrostatic pressure of said first fluid in said first tank, said means comprising a passage having an inlet in fluid communication with said first processing fluid in said first processing tank and an outlet in fluid communication with the processing fluid in said second processing tank, said passage having a configuration such that the difference between said first and second concentrations does not change by more than about 50% over a three day period of non use of said processor.

33. A processor according to claim 32 wherein the difference between said first and second concentrations does not change by more than about 10% over a three day period of non use of said processor.

34. A processor according to claim 32 wherein the difference between said first and second concentrations does not change by more than about 5% over a two week period of non use of said processor.

* * * * *